US009204515B2

(12) United States Patent
Zhang

(10) Patent No.: US 9,204,515 B2
(45) Date of Patent: Dec. 1, 2015

(54) LIGHT SOURCE MODULE, LIGHT SOURCE MODULE DRIVING CIRCUIT AND DRIVING METHOD

(71) Applicant: Shenzhen China Star Optoelectronics Technology Co., Ltd., Shenzhen, Guangdong (CN)

(72) Inventor: Hua Zhang, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 13/985,614

(22) PCT Filed: Jun. 27, 2013

(86) PCT No.: PCT/CN2013/078106

§ 371 (c)(1),
(2) Date: Aug. 15, 2013

(87) PCT Pub. No.: WO2014/183322

PCT Pub. Date: Nov. 20, 2014

(65) Prior Publication Data

US 2014/0333227 A1 Nov. 13, 2014

(30) Foreign Application Priority Data

May 13, 2013 (CN) ..... 2013 1 1749889

(51) Int. Cl.
*H05B 33/08* (2006.01)

(52) U.S. Cl.
CPC ..... *H05B 33/0851* (2013.01)

(58) Field of Classification Search
USPC ..... 315/291, 294, 297
See application file for complete search history.

(56) References Cited

U.S. PATENT DOCUMENTS 7,550,934 B1 * 6/2009 Deng et al. ..... 315/308

* cited by examiner

*Primary Examiner* — Douglas W Owens
*Assistant Examiner* — Jonathan Cooper
(74) *Attorney, Agent, or Firm* — Andrew C. Cheng

(57) ABSTRACT

The present invention discloses a light source module, a light source module driving circuit and a driving method. The driving circuit comprises: a power supply, which provides input voltage; a control signal generating circuit, which inputs the input voltage provided from the power supply and outputs an enable signal and a dimming signal; a driving chip, which is connected with the power supply and connected to the enable signal and the dimming signal output from the control signal generating circuit, driving the light source of the light source module according to the enable signal and the dimming signal. Through the above way, the present invention utilizes the input voltage to generate the enable signal and the dimming signal. Therefore, it only needs to provide external input voltage to control the light source module in operation, which makes the control more convenient and reliable.

9 Claims, 2 Drawing Sheets

LIGHT SOURCE MODULE, LIGHT SOURCE MODULE DRIVING CIRCUIT AND DRIVING METHOD

BACKGROUND OF THE INVENTION

1. Field of the Invention

The present invention relates to the field of display driving, and in particular to a light source module, a light source module driving circuit and a driving method.

2. The Related Arts

Light source module is one of the necessary components in the liquid display module, which is used to provide the required light source of the liquid display panel.

At present, LED light source module is the most popular light source module, as shown in FIG. 1. The present driving circuit of the LED light source module requires three external signals: an input voltage V1, an enable signal ENA, and a dimming signal PWM. Wherein, the input voltage V1, the enable signal ENA, and the dimming signal PWM are respectively connected to the power supply terminal, the enable control terminal, and the input terminal of the dimming signal of the driving chip 16. The input voltage V1 provides the power for the light source module, the enable signal ENA controls the switch of the light source 12, and the dimming signal PWM controls the luminous intensity of the light source 12. Wherein, the input voltage V1 is provided by the power supply 11, the enable signal ENA is input by the external enable signal source 13, the dimming signal PWM is input by the external dimming signal source 14.

Therefore, in the present driving circuit of the LED light source module, the input voltage V1, the enable signal ENA and the dimming signal PWM are controlled by the external input, and these are indispensable. Thus, in the product design and experiment validation stage, the control of the whole driving circuit is more complicate. It is not proper to test the product and adjust the circuit. And when the external enable signal ENA and diming signal PWM are disturbed, the whole circuit will not work normally, which will increase the workload of the test and reduce the working efficiency.

SUMMARY OF THE INVENTION

The technical issue to be solved by the present invention is to provide a light source module, a driving circuit and a driving method of the light source module, which can make the driving circuit of the light source module get the input voltage to generate the enable signal and the dimming signal. Therefore, it makes the light source module work normally.

In order to solve the above issue, the technical solution adopted by the present invention is: providing a light source module driving circuit, the driving circuit comprises; a power supply, which provides input voltage; a control signal generating circuit, which inputs the input voltage provided from the power supply and outputs an enable signal and a dimming signal; a driving chip, which is connected with the power supply and connected to the enable signal and the dimming signal output from the control signal generating circuit, driving the light source of the light source module according to the enable signal and the dimming signal, Wherein, the control signal generating circuit is a step-down circuit, which generates the enable signal and the dimming signal with lower voltages from the input voltage with higher voltage.

Wherein, the control signal generating circuit comprises: a buck chip, the input terminal of the buck chip being connected to the power supply, and the output terminal outputting a regulated voltage VLDO_OUT which is lower than the input voltage; a first resistor, the first end of the first resistor being connected to the output terminal of the buck chip; a second resistor, the first end of the second resistor being connected to the second end of the first resistor, the second end of the second resistor being connected to the ground; a third resistor, the first end of the third resistor being connected to the output terminal of the buck chip; a fourth resistor, the first end of the fourth resistor being connected to the second end of the third resistor, the second end of the fourth resistor being connected to the ground.

Wherein, the output terminal of the enable signal of the control signal generating circuit is connected to an external enable signal source, which outputs the external enable signal provided from the external enable signal source; the output terminal of the dimming signal of the control signal generating circuit is connected to an external dimming signal source, which outputs the external dimming signal provided from the external dimming signal source.

Wherein, the resistance R1, of the first resistor, the resistance R3 of the third resistor, the affordable power dissipation Ps1, Ps3 thereof and the regulated voltage VLDO_OUT meet the requirements of the following formula:

$$R1>(V2LDO_OUT)/Ps1,\ R3>(V2LDO_OUT)/Ps3.$$

In order to solve the above issue, another technical solution adopted by the present invention is providing a light source module, wherein, the driving circuit comprises: a power supply, which provides input voltage; a control signal generating circuit, which inputs the input voltage provided from the power supply and outputs an enable signal and a dimming signal; a driving chip, which is connected with the power supply and connected to the enable signal and the dimming signal output from the control signal generating circuit, driving the light source according to the enable signal and the dimming signal.

Wherein, the control signal generating circuit is a step-down circuit, which generates the enable signal and the dimming signal with lower voltages from the input voltage with higher voltage.

Wherein, the control signal generating circuit comprises: a buck chip, the input terminal of the buck chip being connected to the power supply, and the output terminal outputting a regulated voltage VLDO_OUT which is lower than the input voltage; a first resistor, the first end of the first resistor being connected to the output terminal of the buck chip; a second resistor, the first end of the second resistor being connected to the second end of the first resistor, the second end of the second resistor being connected to the ground; a third resistor, the first end of the third resistor being connected to the output terminal of the buck chip; a fourth resistor, the first end of the fourth resistor being connected to the second end of the third resistor, the second end of the fourth resistor being connected to the ground.

Wherein, the output terminal of the enable signal of the control signal generating circuit is connected to an external enable signal source, which outputs the external enable signal provided from the external enable signal source; the output terminal of the dimming signal of the control signal generating circuit is connected to an external dimming signal source, which outputs the external dimming signal provided from the external dimming signal source.

Wherein, the resistance R1 of the first resistor, the resistance R3 of the third resistor, the affordable power dissipation Ps1, Ps3 thereof and the regulated voltage VLDO_OUT meet the requirements of the following formula:

$$R1>(V2LDO_OUT)/Ps1,\ R3>(V2LDO_OUT)/Ps3.$$

In order to solve the above issue, the other technical solution adopted by the present invention is: providing a driving method of the light source module, wherein, the steps of the driving method comprise: obtaining the output voltage of a power supply; adjusting the output voltage, so that the output voltage generates an enable signal and a dimming signal used to drive the light source module.

Wherein, the step of adjusting the output voltage, so that the output voltage generates an enable signal and a dimming signal used to drive the light source module, comprises: stepping down the output voltage in order to output a regulated voltage VLDO_OUT which is lower than the output voltage; utilizing the resistor to divide the voltage, generating the enable signal and the dimming signal using the regulated voltage.

Wherein, the step of utilizing the resistor to divide the voltage are: utilizing a first resistor and a second resistor to divide the voltage, the node connected with the second end of the first resistor and the first end of the second resistor being the output terminal of the enable signal, outputting the enable signal; utilizing the third resistor and the fourth resistor to divide the voltage, the node connected with the second end of the third resistor and the first end of the fourth resistor being the output terminal of the dimming signal, outputting the dimming signal; wherein, the relations within the resistance R1 of the first resistor, the resistance R2 of the second resistor, the resistance R3 of the third resistor, the resistance R4 of the fourth resistor, the regulated voltage VLDO_OUT, the voltage VENA of the enable signal, and the voltage VPWM of the dimming signal are:

$$VENA=VLDO_OUT\times(R2/(R1+R2));$$

$$VPWM=VLDO_OUT\times(R4/(R3+R4)).$$

The benefits of the present invention are as follows. Differing from the situation of the prior art, the present invention converts the input voltage into the enable signal and the dimming signal through connecting the control signal generating circuit of the input voltage, which allows the input voltage, instead of the external control, converting to the enable signal and the dimming signal without the external controlling enable signal and dimming signal. Therefore, it only needs to provide external input voltage to control the light source module in operation, which makes the control more convenient and reliable.

DETAILED DESCRIPTION OF THE PREFERRED EMBODIMENTS

Figure 1:
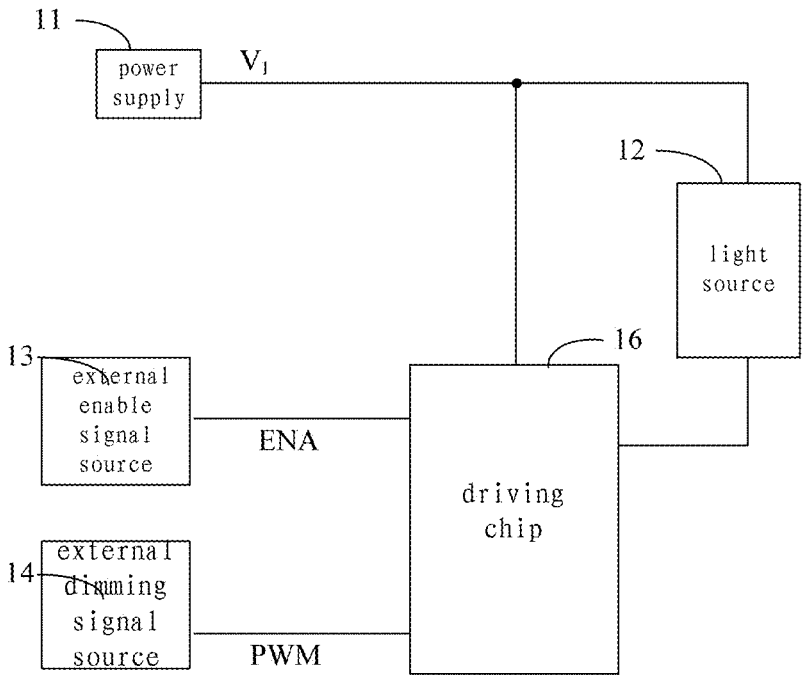
FIG. 1 (Prior Art)
FIG. 1 is a schematic diagram of the light source module according to the prior art.
Figure 2:
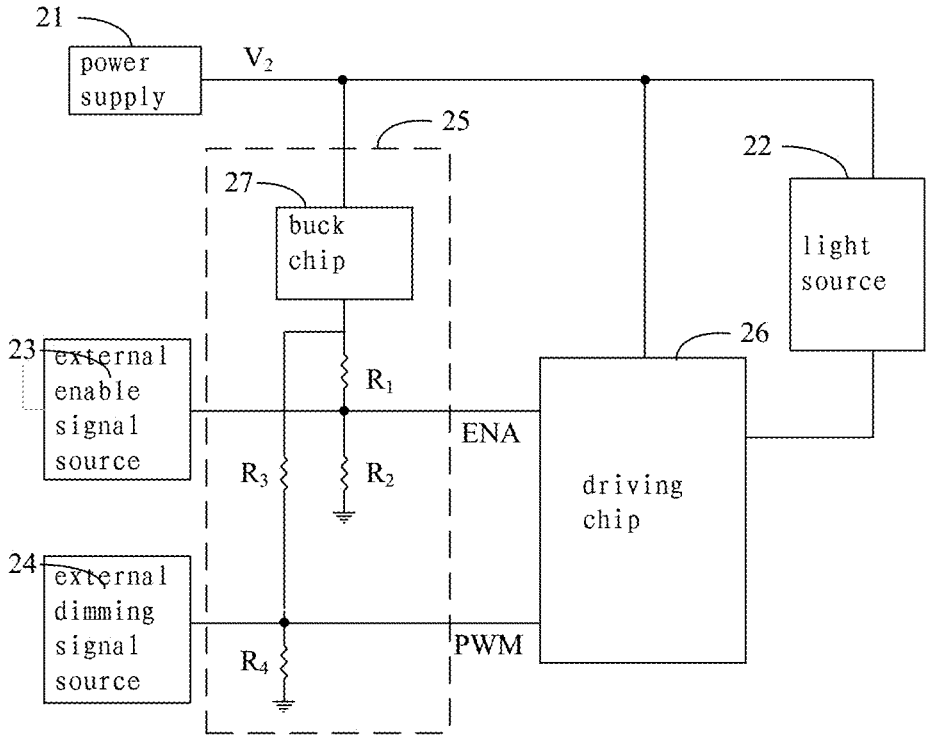
FIG. 2 (Prior Art)
FIG. 2 is a schematic diagram of the light source module according to the first embodiment of the present invention.

Referring to FIG. 2, FIG. 2 is a schematic diagram of the light source module according to the first embodiment of the present invention. The light source module driving circuit according to the first embodiment comprises a power supply 21, a control signal generating circuit 25, and a driving chip 26.

The power supply 21 provides the input voltage V2. The power supply 21 generally is the external power supply 21, which can be transferred through the commercial electricity or batteries.

The control signal generating circuit 25 is inputs the input voltage V2 provided from the power supply 21 and outputs an enable signal ENA and a dimming signal PWM. Generally, the input voltage V2 is higher than the voltage of the enable signal ENA and the dimming signal PWM. The input voltage V2 is generally 24V, while the voltages of the enable signal ENA and the dimming signal PWM are generally 3.3V, Therefore, in the present embodiment, the control signal generating circuit 25 is buck circuit, which generates the enable signal ENA and the dimming signal PWM with lower voltages from the input voltage V2 with higher voltage.

In the present embodiment, the control signal generating circuit 25 comprises a buck chip 27, a first resistor R1, a second resistor R2, a third resistor R3, and a fourth resistor R4. The input terminal of the buck chip 27 is connected to the power supply 21, that is, the input terminal inputs the input voltage V2 provided by the power supply 21, and the output terminal outputs a regulated voltage VLDO_OUT which is lower than the input voltage. Wherein, VLDO_OUT is higher than voltage value of the enable signal ENA and the dimming signal PWM, but is lower than that of the input voltage V2. The value of the VLDO_OUT can be adjusted according to the actual requirements, and it won't be limited here. The first end of the first resistor R1 is connected to the output terminal of the buck chip 27, the first end of the second resistor R2 is connected to the second end of the first resistor R1, the second end of the second resistor R2 is connected to the ground. Wherein, the node connected with the second end of the first resistor R1 and the first end of the second resistor R2 is the output terminal of the enable signal ENA. The first end of the third resistor R3 is connected to the output terminal of the buck chip 27, the first end of the fourth resistor R4 is connected to the second end of the third resistor R3, and the second end of the fourth resistor R4 is connected to the ground. Wherein, the node connected with the second end of the third resistor R3 and the first end of the fourth resistor R4 is the output terminal of the dimming signal PWM.

Through the way described as above, it can convert the input voltage V2 into the enable signal ENA and the dimming signal PWM. Wherein, the relations within the resistance R1 of the first resistor, the resistance R2 of the second resistor, the resistance R3 of the third resistor, the resistance R4 of the fourth resistor, the regulated voltage VLDO_OUT, the voltage VENA of the enable signal, and the voltage VPWM of the dimming signal are:

$$VLDO_OUT\times(R2/(R1+R2));$$

$$VLDO_OUT\times(R4/(R3+R4)).$$

The driving chip 26 is connected to the power supply 21, and is connected to the enable signal ENA and the dimming signal PWM output by the control signal generating circuit 25, in order to drive the light source 22 of the light source module according to the enable signal ENA and the dimming signal PWM.

In order to achieve the requirements of the different customers, the control signal generating circuit 25 according to the present invention can be compatible with the external control circuit, that is, it makes the enable signal ENA and the dimming signal PWM be still subjected to the external control. Connect the output terminal of the enable signal of the control signal generating circuit 25 to the external enable signal source 23, in order to output the external enable signal provided by the external enable signal source 23. Connect the output terminal of the dimming signal of the control signal generating circuit 25 to the external dimming signal source 24, in order to output the external dimming signal provided by the external dimming signal source 24. In other words, the node connected with the second end of the first resistor R1 and the first and of the second resistor R2 is further connected to the external enable signal source 23, the node connected with the second end of the third resistor R3 and the first end of the fourth resistor R4 is further connected to the external dimming signal source 24.

Besides, in the present invention, when the external enable signal provided by the external enable signal source 23 or the external dimming signal provided by the external dimming signal source 24 is high voltage, it will not affect the work of the control signal generating circuit 25. When the external enable signal provided by the external enable signal source 23 or the external dimming signal provided by the external dimming signal source 24 is low voltage, all of the regulated voltage VLDO_OUT output from the buck chip 27 will be consumed between the first resistor R1 and the third resistor R3, the voltage on the second resistor R2 and the fourth resistor R4 is zero, and the external enable signal and the external dimming signal are directly input into the driving chip 26. In other words, at this time, the driving chip 26 is directly controlled by the external enable signal and the external dimming signal, and is not controlled by the control signal generating circuit 25, which implements the compatible of the internal control and external control.

Besides, in order to ensure the first resistor R1 and the third resistor R3 not be burned out during accessing the external control signal. Therefore, the first resistor R1 and the third resistor R3, the affordable power dissipation Ps1, Ps3 thereof, and the regulated voltage VLDO_OUT are meet the requirements of the following formula:

$$R1>(V2LDO_OUT)/Ps1,\ R3>(V2DO_OUT)/Ps3.$$

Figure 3:
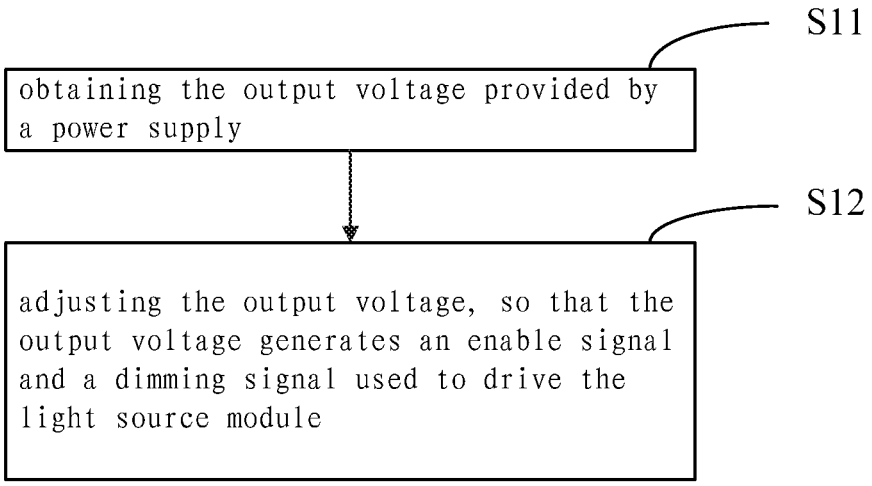
FIG. 3 is a flow chart of the driving method of the light source module according to the second embodiment of the present invention.

Referring to FIG. 3, FIG. 3 is a flow chart of the driving method of the light source module according to the second embodiment of the present invention. In the present embodiment, the driving method of the light source module comprises:

step S11, obtaining the output voltage provided by a power supply;

step S12, adjusting the output voltage, so that the output voltage generates an enable signal and a dimming signal used to drive the light source module.

Specifically, in the step S12, first step down the output voltage in order to output a regulated voltage VLDO_OUT which is lower than the output voltage. Then utilize the resistor to divide the voltage, which generates the enable signal and the dimming signal using the regulated voltage.

The specific way of dividing voltage can be referred to the above embodiment. For example, utilize the first resistor and the second resistor to divide the voltage, the node connected with the second end of the first resistor and the first end of the second resistor is the output terminal of the enable signal, which outputs the enable signal. Utilize the third resistor and the fourth resistor to divide the voltage, the node connected with the second end of the third resistor and the first end of the fourth resistor is the output terminal of the dimming signal. Wherein, the relations within the resistance R1 of the first resistor, the resistance R2 of the second resistor, the resistance R3 of the third resistor, the resistance R4 of the fourth resistor, the regulated voltage VLDO_OUT, the voltage VENA of the enable signal, and the voltage VPWM of the dimming signal are:

$$VENA=VLDO_OUT\times(R2/(R1+R2));$$

$$VPWM=VLDO_OUT\times(R4/(R3+R4)).$$

Figure 4:
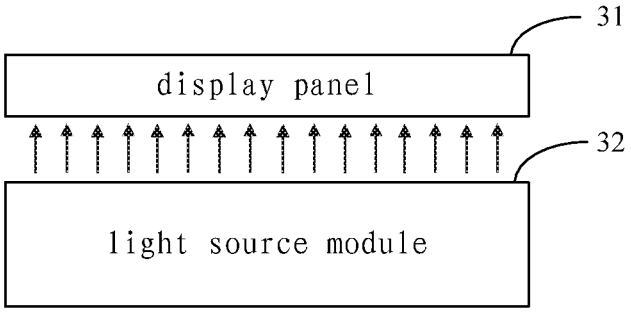
FIG. 4 is a schematic diagram of the display module according to the third embodiment of the present invention.

The present invention further provides a display module. Referring to FIG. 4, FIG. 4 is a schematic diagram of the display module according to the third embodiment of the present invention. In the present embodiment, the display module comprises a display panel 31 and a light source module 32 used to provide the required light source for the display panel 31. Wherein, the light source module 32 is the light source module described in the first embodiment.

Through the above way, the present invention converts the input voltage into the enable signal and the dimming signal through connecting the control signal generating circuit of the input voltage, which makes the input voltage, instead of the external control signal, be converted into the enable signal and the dimming signal without the external controlling enable signal and dimming signal Therefore, it only needs to provide external output voltage to control the light source module working normally, which makes the control more convenient and reliable. It is more convenient for the designer testing the product and adjusting the circuit, which raises the working efficiency.

The preferred embodiments according to the present invention are mentioned above, which cannot be used to define the scope of the right of the present invention. Those modifications and variations are considered encompassed in the scope of protection defined by the claims of the present invention.

What is claimed is:

1. A light source module driving circuit, comprising:

a power supply, which provides an input voltage;

a control signal generating circuit, which inputs the input voltage provided from the power supply and outputs an enable signal and a dimming signal;

a driving chip, which is connected with the power supply and connected to the enable signal and the dimming signal output from the control signal generating circuit, driving the light source of the light source module according to the enable signal and the dimming signal;

wherein, the control signal generating circuit comprises:

a buck chip, an input terminal of the buck chip being connected to the power supply, and an output terminal outputting a regulated voltage VLDO_OUT which is lower than the input voltage;

a first resistor, a first end of the first resistor being connected to the output terminal of the buck chip;

a second resistor, a first end of the second resistor being connected to a second end of the first resistor, a second end of the second resistor being connected to a ground;

a third resistor, a first end of the third resistor being connected to the output terminal of the buck chip;

a fourth resistor, a first end of the fourth resistor being connected to a second end of the third resistor, a second end of the fourth resistor being connected to the ground; and wherein, a node connected with the second end of the first resistor and the first end of the second resistor is an output terminal of the enable signal; a node connected with the second end of the third resistor and the first end of the fourth resistor is an output terminal of the dimming signal.

2. The driving circuit as claimed in claim 1, wherein, the control signal generating circuit comprises a step-down circuit, which generates the enable signal and the dimming signal with lower voltages than the input voltage.

3. The driving circuit as claimed in claim 1, wherein, the output terminal of the enable signal of the control signal generating circuit is connected to an external enable signal source, which outputs the external enable signal provided from the external enable signal source;

the output terminal of the dimming signal of the control signal generating circuit is connected to an external dimming signal source, which outputs the external dimming signal provided from the external dimming signal source.

4. The driving circuit as claimed in claim 3, wherein, the resistance R1 of the first resistor, which is represented in ohm (Ω), the resistance R3 of the third resistor, which is represented in ohm (Ω), the affordable power dissipation Ps1, Ps3 thereof, which are represented in watts (W), and the regulated voltage VLDO_OUT, which is represented in volts (V), meet the requirements of the following formula:

$$R1\ (\Omega)>(V2LDO_\mathrm{OUT})(V)/Ps1(W), R3\ (\Omega)>(V2LDO_\mathrm{OUT})(V)/Ps3(W).$$

5. A light source module, wherein, the light source module comprises a light source and a driving circuit, the driving circuit being connected to the light source in order to drive the light source, wherein, the driving circuit comprises:

a power supply, which provides an input voltage;

a control signal generating circuit, which inputs the input voltage provided from the power supply and outputs an enable signal and a dimming signal;

a driving chip, which is connected with the power supply and connected to the enable signal and the dimming signal output from the control signal generating circuit, driving the light source according to the enable signal and the dimming signal;

wherein, the control signal generating circuit comprises:

a buck chip, an input terminal of the buck chip being connected to the power supply, and an output terminal outputting a regulated voltage VLDO_OUT which is lower than the input voltage;

a first resistor, a first end of the first resistor being connected to the output terminal of the buck chip;

a second resistor, a first end of the second resistor being connected to a second end of the first resistor, a second end of the second resistor being connected to a ground;

a third resistor, a first end of the third resistor being connected to the output terminal of the buck chip;

a fourth resistor, a first end of the fourth resistor being connected to a second end of the third resistor, a second end of the fourth resistor being connected to the ground;

wherein, a node connected with the second end of the first resistor and the first end of the second resistor is an output terminal of the enable signal; a node connected with the second end of the third resistor and the first end of the fourth resistor is an output terminal of the dimming signal.

6. The driving circuit as claimed in claim 5, wherein, the control signal generating circuit comprises a step-down circuit, which generates the enable signal and the dimming signal with lower voltages than the input voltage.

7. The driving circuit as claimed in claim 5, wherein, the output terminal of the enable signal of the control signal generating circuit is connected to an external enable signal source, which outputs the external enable signal provided from the external enable signal source;

the output terminal of the dimming signal of the control signal generating circuit is connected to an external dimming signal source, which outputs the external dimming signal provided from the external dimming signal source.

8. The driving circuit as claimed in claim 7, wherein, the resistance R1 of the first resistor, which is represented in ohm (Ω), the resistance R3 of the third resistor, which is represented in ohm (Ω), the affordable power dissipation Ps1, Ps3 thereof, which are represented in watts (W), and the regulated voltage VLDO_OUT, which is represented in volts (V), meet the requirements of the following formula:

$$R1\ (\Omega)>(V2LDO_\mathrm{OUT})(V)/Ps1(W), R3\ (\Omega)>(V2LDO_\mathrm{OUT})(V)/Ps3(W).$$

9. A driving method of a light source module, wherein, the steps of the driving method comprise:

obtaining an output voltage of a power supply;

stepping down the output voltage in order to output a regulated voltage VLDO_OUT which is lower than the output voltage;

utilizing a first resistor and a second resistor to divide the voltage, a node connected with a second end of the first resistor and a first end of the second resistor being an output terminal of an enable signal, outputting the enable signal; utilizing a third resistor and a fourth resistor to divide the voltage, a node connected with a second end of the third resistor and a first end of the fourth resistor being an output terminal of a dimming signal, outputting the dimming signal; wherein, the relations within a resistor R1 of the first resistor, which is represented in ohm (Ω), a resistance R2 of the second resistor, which is represented in ohm (Ω), a resistance R3 of the third resistor, which is represented in ohm (Ω), a resistance R4 of the fourth resistor, which is represented in ohm (Ω), a regulated voltage VLDO_OUT, which is represented in volts (V), a voltage VENA of the enable signal, which is represented in volts (V), and a voltage VPWM of the dimming signal, which is represented in volts (V), are:

$$VENA(V)=VLDO_\mathrm{OUT}(V)\times(R2\ (\Omega)/(R1\ (\Omega)+R2\ (\Omega)));$$

$$VPWM(V)=VLDO_\mathrm{OUT}(V)\times(R4\ (\Omega)/(R4\ (\Omega)+R4\ (\Omega))).$$

* * * * *